United States Patent [19]

Smith

[11] 3,992,992

[45] Nov. 23, 1976

[54] DAMPENER FOR PRINTING PRESS

[75] Inventor: Walter S. Smith, Naperville, Ill.

[73] Assignee: Rockwell International Corporation, Pittsburgh, Pa.

[22] Filed: Jan. 13, 1976

[21] Appl. No.: 648,797

[52] U.S. Cl. ..... 101/148; 101/366

[51] Int. Cl.[2] ..... B41F 7/30

[58] Field of Search ..... 101/148, 147, 366; 118/320, 7,8

[56] References Cited

UNITED STATES PATENTS

| | | | |
|---|---|---|---|
| 1,719,017 | 7/1929 | Moe`et al. | 101/148 |
| 2,233,210 | 2/1941 | Huck | 101/147 |
| 2,791,174 | 5/1957 | Koch | 101/147 |
| 3,924,531 | 12/1975 | Klingler | 101/147 |

*Primary Examiner*—J. Reed Fisher

[57] ABSTRACT

A dampener for lithographic printing presses is disclosed wherein means are provided for continuously generating a spray or mist of dampening fluid having optimum particle size and density characteristics and the volume of spray which is permitted to reach the plate cylinder is metered by a series of baffles that extend over the full length of the plate cylinder. The baffles are all connected for movement in unison with a common control member that is responsive automatically to changes in press speed to thereby control the overall volume of spray that reaches the plate cylinder with direct relation to the speed of the press and each individual baffle is selectively adjustable relative to the control member whereby to meter the volume of spray at local areas along the length of the plate cylinder.

7 Claims, 4 Drawing Figures

DAMPENER FOR PRINTING PRESS

BACKGROUND OF THE INVENTION

Spray type dampeners have been known and used for many years to dampen the plates of lithographic printing presses. Most of them employ revolving brushes with a coacting pan roller, deflector blades or the like to generate the required spray which is directed toward the plate cylinder and the volume of spray is regulated by varying the speed of the rotating brush and/or by adjusting the position of the deflector blades. The known devices have not been satisfactory, however, because of their inability to generate a consistently uniform spray at all press speeds. Each such device has an optimum brush speed and/or deflector blade setting at which it will generate a spray having the required particle size and density and, therefore, if the speed of the brush or the position of the deflector blade is changed to accommodate a change in press speed, the characteristics of the spray are changed, usually with adverse effects upon the quality of the printed product.

A further disadvantage of the known dampeners resides in the fact that the brush bristles not only become contaminated with ink after short periods of operation, but they are also subject to relatively rapid wear and each such condition produces a change in the characteristics of the spray. As a result, relatively frequent readjustments or replacements of the brush are required to obtain reasonably consistent results.

In some instances, manually adjustable baffles have been used, either alone or in combination with brush speed adjustments, to regulate the volume of spray. Such means also have proved to be unsatisfactory because initial adjustments and frequently, repeated readjustments of the baffles are required each time the press speed is changed and before the proper ink/water balance is achieved. In a multi-unit press such practice requires the manual adjustment of a substantial number of baffles which is not only tedious and time consuming, but also results in substantial amounts of waste before the required settings are achieved.

SUMMARY OF THE INVENTION

The present invention overcomes the deficiencies and disadvantages of the prior dampening devices by providing improved spray generating and volume control means. The spray generating means of the present invention are adapted to operate continuously at a predetermined speed which produces a spray having the optimum density and particle size characteristics required for high quality printing and the overall volume control, as well as local volume control, of the spray is regulated by a series of adjustable baffles. The baffles are all connected to a common control member that is automatically responsive to changes in press speed and which is adapted to adjust the positions of all of the baffles in unison upon a change in press speed to thereby adjust the overall volume of spray with direct relation to the speed of the press and each individual baffle is selectively adjustable relative to the control member to effect local adjustments of the spray volume, when necessary, along the length of the plate cylinder.

DETAILED DESCRIPTION

With reference now to the drawings the invention is illustrated, merely by way of example, as embodied in a rotary, lithographic newspaper printing press wherein each printing unit has a rotatable plate cylinder 10 that is adapted to carry four axially adjacent lithographic printing plates mounted about the peripheral surface thereof. In operation and during each revolution of the plate cylinder, the printing plates are adapted to first receive a supply of dampening fluid from the dampening device, indicated in its entirety by the numeral 11, whereupon the plates pass beneath a plurality of inking rollers, not shown, to receive a supply of ink on the image areas thereof.

The dampening fluid may be sprayed directly onto the plates on the plate cylinder as it revolves past the dampening mechanism but it is preferred to employ one or more dampening rollers such as 12 to receive the dampening fluid from the spray generating means and thereafter deposit the fluid upon the printing plates in the form of a thin, uniform film as is well known in the art.

The invention may be used with advantage in combination with any of the known spray generating type dampening devices. However, it has been illustrated and will be described hereinafter, merely by way of example, as incorporated in a dampener having improved spray generating means such as is disclosed in the copending application Ser. No. 561,600, filed Mar. 24, 1975 and having the same assignee as the present application. Accordingly, only the essential elements of the spray generating portion of said dampener have been illustrated herein and reference may be had to said copending application for more specific details, if necessary.

Figure 2:
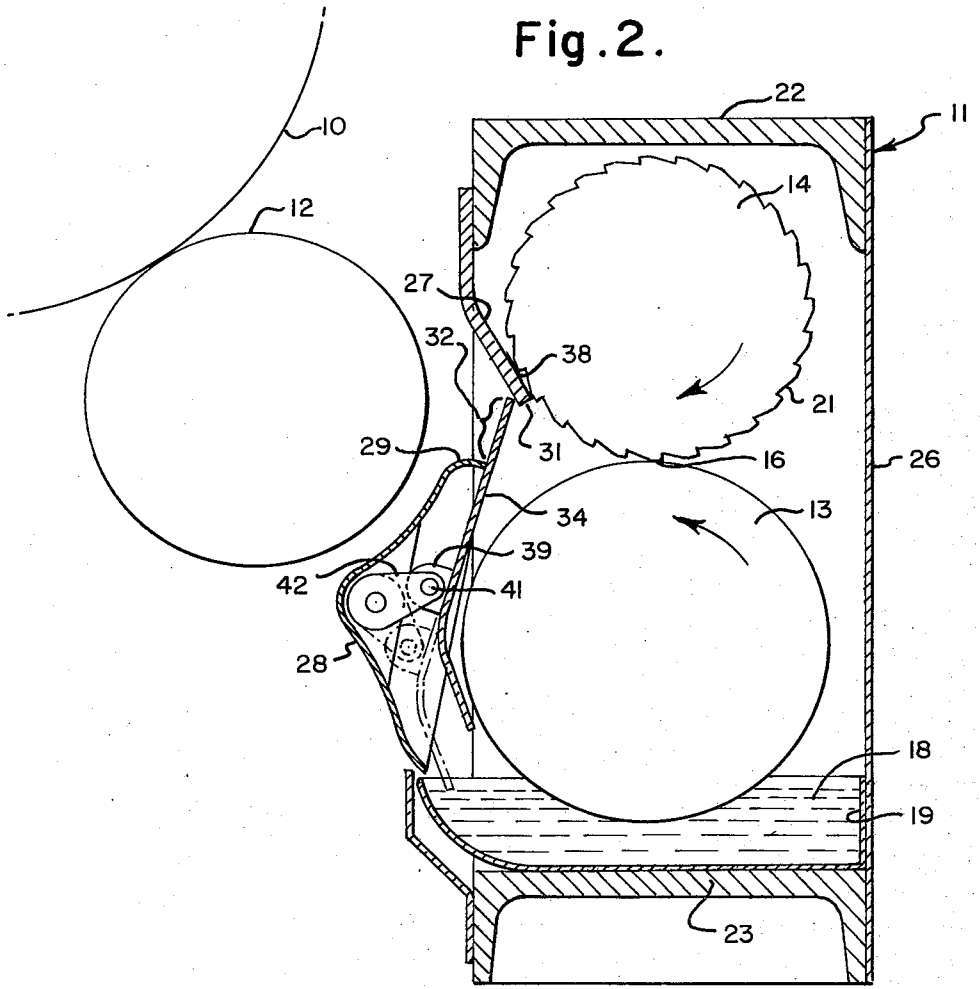
FIG. 2 is a sectional view taken along the line 2—2 of FIG. 1.

As best illustrated in FIG. 2, the dampening mechanism 11 includes a pair of coacting rollers 13 and 14 that are mounted for rotation about respective axes parallel to the plate cylinder and which form a spray generating nip at 16. The roller 13 has a smooth, continuous, resilient surface that is coextensive with the plate cylinder 10 and it is arranged to be partially immersed in a reservoir of dampening fluid 18 contained in a pan 19 so that upon rotation in the direction indicated by the arrow and at a predetermined surface speed, it will convey a constant supply of fluid to the nip 16 in the form of a thin, uniform film.

The roller 14, in turn, is formed of a hard substance, preferably metal, and is provided about its peripheral surface with a series of equi-spaced, longitudinally disposed grooves or flutes 21 which, upon rotation of the roller 14 in the direction indicated, and at a much higher speed than the roller 13, function to generate a spray from the fluid in the nip 16 and direct it toward the plate cylinder 10.

Both the pan roller 13 and the mist generating roller 14 are substantially completely enclosed within a housing comprised of upper and lower cross members 22 and 23, respectively, side frame members 24 and 25 and a back panel 26. On the front side thereof adjacent the roller 12 the housing is provided with a fixed baffle 27 along the upper portion thereof which extends across the full width of the dampener and is secured to the upper cross member 22. A second fixed baffle 28 of generally V shape in cross-section, extends across the lower portion of the front side of the housing with the ends thereof being secured to the side frame members 24 and 25 and in a manner that the upper edge 29 of the baffle 28 is spaced from the lower edge 31 of the baffle 27. A longitudinal slot 32 is thereby provided which extends across the full width of the housing and through which the spray that is generated in the nip 16 can pass to impinge on the roller 12.

As explained in the referenced application, separate drive means are provided for regulating the surface speeds of the rollers 13 and 14 so that the particle size and density characteristics of the generated spray, as well as the volume thereof reaching the plate cylinder can be controlled. It was further stated in said application, however, that because the coacting rollers have optimum speeds at which they generate a spray having the desired density and particle size, it was preferred to operate the rollers continuously at such optimum speeds and to regulate the volume of spray by varying the area of the slot 32 by means of a series of independent, manually adjustable baffles.

Although capable of providing the necessary control, such manually adjustable baffles proved to be unsatisfactory, particularly on multi-unit presses. Each time the press speed was changed it was necessary for the pressman to adjust, and frequently readjust, all of the baffles of each printing unit before acceptable settings were achieved. This, not only was tedious and time consuming, but often resulted in excessive waste before the proper ink/water balance on all units could be established.

To obviate these objectionable conditions, the present invention contemplates the use of a series of baffles arranged side by side so as to extend over the full width of the plate cylinder and which are arranged to be controlled automatically by means directly responsive to changes in press speed to vary the area of the slot 32 and thereby meter the volume of spray reaching the plate cylinder with direct relation to the speed of the press.

Figure 1:
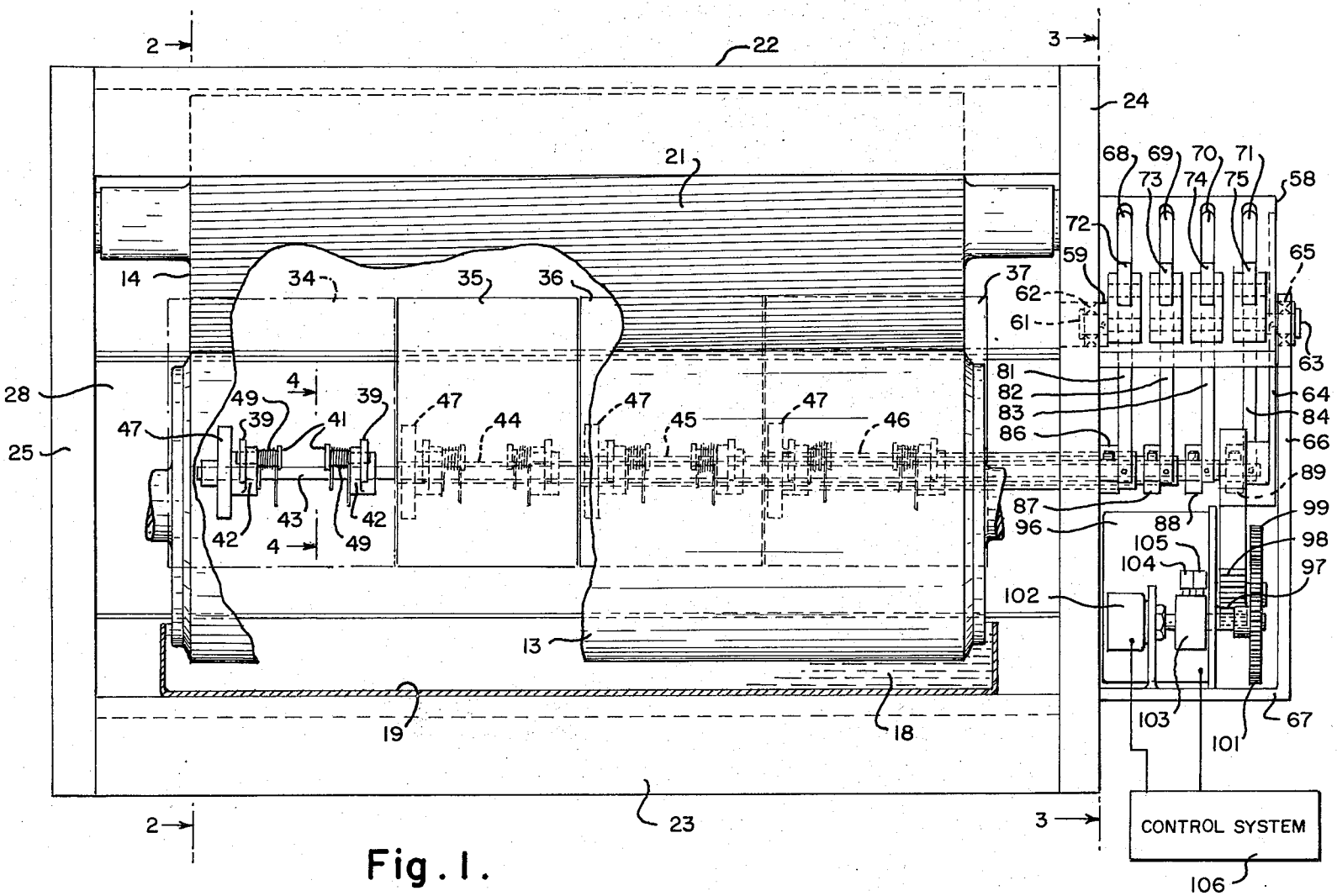
FIG. 1 is a front elevational view, with portions broken away for clarity, illustrating the invention as embodied in a double width, four page wide, rotary newspaper press.

As illustrated in FIG. 1, a series of four baffles 34, 35, 36 and 37 are employed each of which is substantially equivalent in width to the width of a page size printing plate and thus each baffle serves to meter the volume of dampening fluid to its respective plate. This, of course, is for illustrative purposes only and it will be understood that a greater number of baffles may be employed, one for each column width, for example, depending upon the fineness of control desired.

The baffles are arranged to be adjustable in a substantially vertical direction between a fully closed position wherein the top edge 38 thereof is in contact with the shield 27 to prevent any spray from reaching the roller 12 and a full open position wherein the top edge 38 is adjacent the edge 29 of the fixed baffle 28 to thereby allow the maximum volume of spray to impinge on the roller 12. For this purpose, the baffles are each provided with a pair of spaced brackets 39 which are attached to the side thereof adjacent the roller 12 and these brackets, in turn, are mounted by means of pivot pins 41 to the ends of support levers 42 that are mounted on respective ones of a series of coaxially arranged control shafts 43, 44, 45 and 46.

With particular reference to FIG. 1, it will be seen that the control shafts 43–46 are of progressively larger diameters so that they can be telescoped over each other for independent rotary motion about a common axis and they are also of differing lengths. The longest control shaft 43, for example, which is adapted to control the position of baffle 34, extends substantially, from the left hand side of baffle 34, as viewed in FIG. 1, through and beyond the side frame 24. Control shaft 44 for baffle 35 is telescoped over shaft 43 and extends from the left side of said baffle through and beyond the side frame 24 but to a somewhat shorter distance than shaft 43. The control shafts 45 and 46 for baffles 36 and 37, respectively, are likewise telescoped over each other and over shaft 44 and extend from the left hand side of their respective baffles through and to progressively shorter distances beyond the side frame 24. The control shafts are all mounted for rotation in the frame 24 at one end, and in a series of brackets 47 secured to the fixed baffle 28 and which brackets are spaced apart so as to support the left hand end of the respective shafts.

Figure 4:
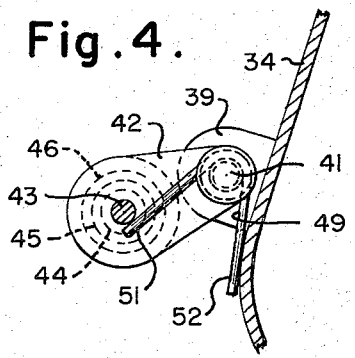
FIG. 4 is an enlarged fragmentary view taken along line 4—4 of FIG. 1.

From the description thus far, it will be evident that when the shafts 43 to 46 are oscillated, either in unison or independently, the respective baffles will be raised and lowered between their full open and closed positions as indicated by the broken and solid lines in FIG. 2, to thereby meter the volume of spray reaching their respective printing plates as required. During such reciprocating movements, the respective baffles are biased in a counterclockwise direction about the axes of the pivot pins 41 to thereby maintain the baffles in contact with the edge 29 of the fixed baffle 28 by means of torsion springs 49. These springs are mounted about the respective pivot pins 41 in a manner that the projecting ends 51 and 52 thereof, see FIG. 4, are confined between and thus exert a constant force on, the adjacent control shaft and the adjacent face of the respective baffles 34 to 37.

During operation of the press, the vertical positions of the baffles are adapted to be regulated with relation to the speed of the press by control means located outside the frame member 24 and which control the angular positions of the respective shafts 43 to 46.

Figure 3:
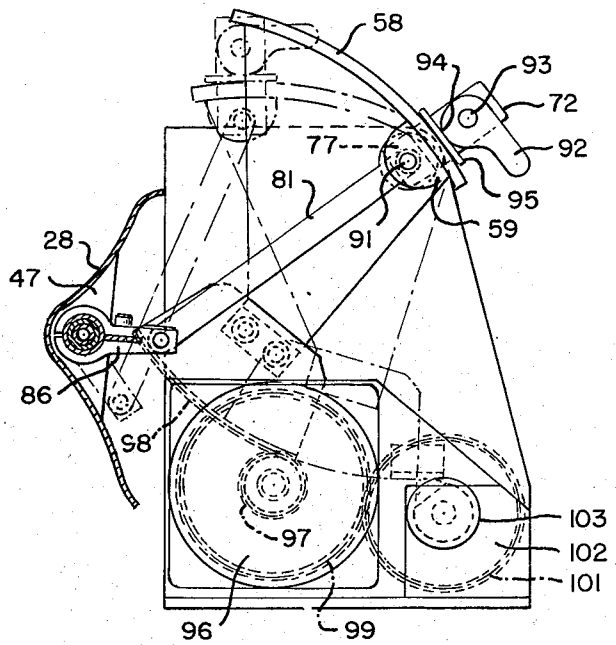
FIG. 3 is a sectional view taken along line 3—3 of FIG. 1.

As will be seen more clearly in FIGS. 1 and 3 the control means essentially consist of a main control member in the form of an arcuate cam plate 58 which is pivotally mounted for movement about a fixed axis between a closed position indicated by solid lines in FIG. 3, and a maximum water feed position indicated by the broken lines in said Figure. At one side thereof the cam plate 58 is provided with a depending bracket 59 to provide support for a pivot pin 61 which pin, in turn, is journalled for rotation in a bearing 62 seated in the frame member 24. At the opposite side thereof the cam plate 58 is supported for pivoting motion by means of a second pivot pin 63. This pin is secured in an arm 64 attached to the cam plate and it is journalled for rotation in a bearing 65 mounted in the vertical extension 66 of an auxiliary frame member 67 attached to the frame member 24.

The cam plate 58 also is provided with a series of elongated, parallel slots 68, 69, 70 and 71 in the face thereof to accommodate a corresponding number of regulating knobs 72, 73, 74 and 75, respectively, which are adapted to be manually adjustable in the respective slots to thereby adjust the positions of the baffles relative to the cam plate as will be explained more fully hereinafter. Each regulating knob 72–75 has an arm 77, 78, 79, and 80 that projects through its respective slot in the cam plate 58 and each said arm is connected by a link 81, 82, 83, 84 to a lever 86, 87, 88, 89 that is clamped securely to the projecting end of the respective control shafts 43–46. The links 81–84 are connected to the respective regulating knobs 72–75 by means of pivot pins 91 and it is important to note that when the said knobs are in the closed position, to the extreme right end of the slots 68–71, as viewed in FIG. 3, the axes of said pins 91 are precisely coincident with the common axis of the pivot pins 61 and 63 for the cam plate 58.

To maintain the regulating knobs in any selected position lengthwise of the slots 68–71, each said knob is provided with a locking lever 92 which is pivotally mounted thereon by means of a pivot pin 93. The levers 92 are formed with an eccentric node 94 which, when the lever is in the locked position as illustrated in FIG. 3, serves to press a collar 95 against the face of the cam plate 58 to thereby secure the regulating knob against unintended movement. When the locking lever 92 is turned 90° in a counterclockwise direction to its release position, the pressure on the collar 95 is relieved and the knob can then be adjusted manually to any selected position along the slot 68–71 to thereby regulate the position of its respective baffle relative to the position of the cam plate 58.

During operation of the press, the angular position of the cam plate 58 and thus the positions of the respective baffles is arranged to be controlled with direct relation to the speed of the press by means of a synchronous motor 96 mounted on the auxiliary frame 67. The output shaft of the motor is provided with a small pinion gear 97 which meshes with a gear sector 98 attached to the end of the arm 64 of the cam plate 58 and thus as the motor 96 is rotated in clockwise or counterclockwise directions, the cam plate 58 will be oscillated between its closed and full open positions to thereby regulate the positions of the baffles 34–37 with direct relation to press speed.

A second pinion gear 99 on the output shaft of motor 96 is adapted to mesh with a gear 101 secured on the shaft of a potentiometer 102 which generates an electrical signal proportional to the position of the cam plate 58 and which may be used to monitor the positions of the baffles while the press is in operation. The shaft of the potentiometer 102 is also provided with a cam disc 103 which is adapted to coact with limit switches 104 and 105 to thereby limit the movement of the cam plate 58 between its closed and full open positions.

As indicated in FIG. 1, the synchronous motor 96 and the potentiometer 102 are connected to and controlled by a control system 106 which generates an electrical signal proportional to the speed of the press. The details of the control system have not been disclosed because they do not constitute an element of the present invention and any suitable means may be used for this purpose such as, for example, the control system disclosed in U.S. Pat. No. 3,700,984.

Having thus described the various elements of the invention the manner in which it operates is as follows.

At the beginning of a press run and before the press per se is set in operation, the drive means for the spray generating rollers 13 and 14 will be activated to drive said rollers at the predetermined surface speeds at which they generate a spray having the optimum density and particle size characteristics. The cam plate 58 will be in its closed position, as indicated by the solid lines in FIG. 3, and the regulating knobs 72–75 will be moved to a normal position substantially midway between the extreme ends of the slots 68–71. With the regulating knobs and cam plate in such positions the respective control shafts 43–46 will be rocked to their limit position in a counterclockwise direction and the baffles 34–37 will be closed with the top edges 38 thereof in contact with the fixed baffle 27.

Upon starting of the press at slow speed, the control system 106 will generate an electrical signal proportional to the press speed to activate the synchronous motor 96 through a corresponding angle. Through the gear 97 and gear sector 98, the cam plate 58 will be pivoted a proportional amount about the pivot axis of the pivot pins 61–63 toward its open position and, in so doing it will depress the levers 86–89 on the control shafts 43–46 through the regulating knobs 72–75 and connecting links 81–84. The resultant rocking of the shafts 43–46 will, in turn, retract the respective baffles to a predetermined extent thereby partially opening the slot 32 and permitting a minimum volume of spray to reach the plate cylinder 10. Obviously, as the speed of the press is increased, the synchronous motor will turn to a greater extent until, at full press speed the cam plate 58 will be in its full open, broken line position of FIG. 3 and the baffles will be fully retracted to permit maximum water feed.

If, after the press has been in operation for a period of time, it is determined that certain portions of the plate are receiving too little or too much water, this can be corrected by releasing the locking lever 92 and manually adjusting the appropriate regulating knob 72–75 to thereby adjust the position of the appropriate baffle relative to the cam plate 58. Once such an adjustment has been effected, the precise volume of water reaching the plate will be controlled automatically with direct relation to any changes in press speed.

In the event that water is to be shut off completely from any portion of the plate cylinder during operation of the press, the regulating knob 72–75 for the appropriate baffle will be moved to the off position, to the extreme right as viewed in FIG. 3. In such case, the pivot axis of the pivot pin 91 will be coincident with the pivot axis of the cam plate 58 and thus the selected regulating knob 72–75 will merely pivot about said axis as the cam plate oscillates between its closed and open positions and no corresponding motion will be imported to the selected baffle.

Although none have been shown in the drawings, it will be understood that the cam plate 58 can be provided with indicia along the respective slots 68–71 to indicate the setting of the respective regulating knobs. This is of advantage in that the positions of the regulating knobs 72–75 during a production run can be recorded and retained. Accordingly, when the same job is to be run again the knobs can be preset to the recorded positions thereby eliminating the need for any readjustments once the press has been set in operation.

I claim:

1. Mechanism for dampening a plate on the plate cylinder of a printing press comprising means for generating and directing a liquid spray of dampening fluid toward said plate cylinder, a series of baffles located between said spray generating means and said plate cylinder, means mounting said baffles for movement between a closed position and an open position to thereby meter the volume of spray reaching said plate cylinder, a control member mounted for movement between an off position and an open position, power means responsive to changes in press speed for infinitely varying the position of said control member between said off and open positions with direct relation to the speed of the press, and means interconnecting the baffle mounting means with said control member for movement of said baffles therewith between said open and closed positions to thereby control the volume of spray reaching said plate cylinder with relation to the speed of the press.

2. Mechanism as set forth in claim 1 further including manually operable means incorporated in said interconnecting means for selectively adjusting the positions of the respective baffles relative to said control member to thereby vary the volume of spray reaching said plate cylinder at local areas along the length thereof.

3. Mechanism as set forth in claim 1 wherein said spray generating means comprises a rotatable pan roller having a smooth, continuous, resilient surface and a coacting hard roller having longitudinally disposed grooves in the surface thereof.

4. Mechanism as set forth in claim 1 wherein said baffle mounting means comprise a series of coaxially arranged, rotatable shafts, lever means fixedly secured to the respective shafts, and means pivotally connection the free ends of said lever means to the respective baffles.

5. Mechanism as set forth in claim 4 further including torsion springs mounted on said pivotal connecting means for continuously biasing said baffles against a control surface in all adjusted positions thereof.

6. Mechanism as set forth in claim 1 wherein said control member comprises an arcuate plate mounted for pivoting motion about a fixed axis at one end thereof, an arm connected to said plate, and a gear sector secured to the free end of said arm for coaction with said power means.

7. Mechanism as set forth in claim 1, wherein said interconnecting means include a lever secured to each of the respective baffle mounting means, manually releasable clamp means mounted on said control member, and a link pivotally connected between the respective levers and releasable clamp means.

* * * * *